US009689190B2

(12) United States Patent
Wu

(10) Patent No.: US 9,689,190 B2
(45) Date of Patent: Jun. 27, 2017

(54) INTELLIGENT CONTROL SYSTEM FOR REMOTE CONTROL OF DOORS AND WINDOWS

(71) Applicant: Shanghai TOB Intelligent Doors and Windows Science&Technology Inc., Shanghai (CN)

(72) Inventor: Hao Wu, Shanghai (CN)

( * ) Notice: Subject to any disclaimer, the term of this patent is extended or adjusted under 35 U.S.C. 154(b) by 0 days.

(21) Appl. No.: 15/019,972

(22) Filed: Feb. 10, 2016

(65) Prior Publication Data

US 2016/0376826 A1 Dec. 29, 2016

(30) Foreign Application Priority Data

Jun. 26, 2015 (CN) ..... 2015 1 0361801
Jun. 26, 2015 (CN) ..... 2015 2 0448323 U
(Continued)

(51) Int. Cl.
*G08B 13/08* (2006.01)
*E05F 15/70* (2015.01)

(52) U.S. Cl.
CPC ..... *E05F 15/70* (2015.01); *G08B 13/08* (2013.01); *E05Y 2900/10* (2013.01)

(58) Field of Classification Search
CPC ..... H04W 88/06; H04W 64/00; H04W 12/06; H04W 88/02; H04W 4/023; H04W 4/025;
(Continued)

(56) References Cited

U.S. PATENT DOCUMENTS

2007/0032246 A1* 2/2007 Feher ..... H04W 64/00 455/456.1
2007/0106892 A1* 5/2007 Engberg ..... G06Q 20/02 713/168
(Continued)

*Primary Examiner* — Daniel Previl
(74) *Attorney, Agent, or Firm* — Wayne & Ken, LLC

(57) ABSTRACT

The present invention provides an intelligent control system for remote control of doors and windows, comprising an intelligent control end, a server and a control terminal of doors and windows. The intelligent control end sends a remote control command to the control terminal of doors and windows through the server. The control terminal of doors and windows processes the received remote control command and executes a corresponding control action to finish remote control of doors and windows, wherein the control terminal of doors and windows comprises an MCU. The MCU is connected with a signal receiving/transmission component, a mechanical component for control of doors and windows, a detection component of doors and windows, a position detection component of doors and windows and an anti-theft component. In the intelligent control system for remote control of doors and windows of the present invention, the intelligent control end sends a control signal to a remote control terminal of doors and windows for realizing remote control of doors and windows. The intelligent control system has the characteristics of simple system design, ultra-low power consumption and large-scale use, and can be used for remote control of diversified doors and windows like skylights, flat open doors and windows, doors and windows opened inside and outside, sliding doors and windows, etc.

1 Claim, 8 Drawing Sheets

(30) Foreign Application Priority Data

Jun. 26, 2015 (CN) ..... 2015 2 0448325 U
Jun. 26, 2015 (CN) ..... 2015 2 0448441 U
Jun. 26, 2015 (CN) ..... 2015 2 0448442 U

(58) Field of Classification Search
CPC ..... H04W 4/22; H04W 84/06; H04W 48/02; H04W 48/10; H04W 4/008; H04W 72/1215; H04W 72/1242; H04W 84/12; H04W 84/18
USPC ..... 340/547, 521, 644, 545.1, 542, 545.6, 340/545.7, 545.8, 545.9, 567, 568.1
See application file for complete search history.

(56) References Cited

U.S. PATENT DOCUMENTS

2007/0182543 A1* 8/2007 Luo ..... G08B 25/00 340/521
2009/0140858 A1* 6/2009 Gore ..... G08B 13/04 340/547
2009/0244402 A1* 10/2009 Rye ..... G08C 17/00 348/734
2011/0155516 A1* 6/2011 Mason ..... B66B 5/024 187/384
2014/0232120 A1* 8/2014 Wolf ..... E05B 65/0888 292/262

* cited by examiner

INTELLIGENT CONTROL SYSTEM FOR REMOTE CONTROL OF DOORS AND WINDOWS

CROSS-REFERENCE TO RELATED APPLICATIONS

This application claims foreign priority benefits to Chinese Patent Application No. 201510361801.5, filed Jun. 26, 2015; Chinese Patent Application No. 201520448323.7, filed Jun. 26, 2015; Chinese Patent Application No. 201520448325.6, filed Jun. 26, 2015; Chinese Patent Application No. 201520448441.8, filed Jun. 26, 2015; Chinese Patent Application No. 201520448442.2, filed Jun. 26, 2015. The content of the aforementioned applications, including any intervening amendments thereto, is incorporated herein by reference in their entirety.

TECHNICAL FIELD

The present invention relates to an intelligent control system for remote control of doors and windows.

BACKGROUND

Doors and windows are essential devices in home life, but the doors and the windows in existing families are mostly manual doors and windows. It is common to forget closing the windows in case of rain, wind and other heavy weather; many people on a business trip also worry that nobody can open the windows in time for ventilation, so that the bad smell is presented when the people get home every time; and a plurality of automatic doors in the existing market are complicated in structure and troublesome in installation and even need redecoration, which needs too much cost for many people wanting to have automatic control doors and windows. Currently, a driving device for doors and windows mostly used in the existing market is mainly controlled by a switchgear device, and the device realizes the transmission of force generally by virtue of a chain mechanism. The chain mechanism has a plurality of kinematic pairs and high requirement for coordinating precision, which causes that a transmission mechanism usually has the characteristics of high complexity and poor reliability, and then, causes that the product has unstable operation, strong vibration, many faults, low service life, etc.

Tsinghua University proposes an automatic opening and closing device of curtain walls and doors and windows, having the patent number of CN104453529, and comprising: a hydraulic power unit, wherein the hydraulic power unit is connected with a hydraulic push rod through a hydraulic pipeline, the telescopic end of the hydraulic push rod is hinged with one end of a connecting rod, and the other end of the connecting rod is hinged with an object to be pushed and pulled. The technical solution has the advantages of stable operation of the doors and the windows, no vibration and no noise; but due to the factor of a mechanical structure of the automatic opening and closing device itself, the intelligent remote control function cannot be realized.

With the rapid development of a communication technology, an electronic technology and a control technology, various intelligent home alarm and control systems emerge. The existing intelligent control system of doors and windows induces the change of an external environment mostly by virtue of a built-in sensor, thereby realizing the control for the doors and the windows. But the close remote control or remote control is impossible, so the popular demand still cannot be satisfied.

SUMMARY OF THE PRESENT INVENTION

With respect to the above problems, the purpose of the present invention is to provide an intelligent control system for remote control of diversified doors and windows with low cost. The intelligent control system can be used for remote control of diversified doors and windows like skylights, flat open doors and windows, doors and windows opened inside and outside, sliding doors and windows, etc., and has the advantages of simple design, energy saving, environmental protection, safety and stability. The present invention has the technical solution as follows:

An intelligent control system for remote control of doors and windows comprises:

an intelligent control end, a server and a control terminal of doors and windows; the intelligent control end sends a remote control command to the control terminal of doors and windows through the server; the control terminal of doors and windows processes the received remote control command and executes a corresponding control action to finish remote control of doors and windows.

Wherein, the control terminal of doors and windows comprises an MCU; the MCU is connected with a signal receiving/transmission component, a mechanical component for control of doors and windows, a detection component of doors and windows, a position detection component of doors and windows and an anti-theft component;

The signal receiving/transmission component is used for receiving control information and sending information to the intelligent control end;

The mechanical component for control of doors and windows comprises a motor control circuit, a driving mechanism and doors and windows connected with the driving mechanism; the motor control circuit is connected with the driving mechanism for controlling the action of the driving mechanism to realize the control of the doors and the windows.

The signal receiving/transmission component is connected to the MCU through an SPI or a UART interface;

The detection component of doors and windows comprises a first current detection circuit, a signal amplification circuit and an AD conversion circuit which are electrically connected successively; the AD conversion circuit is connected to the MCU; and if the current information received by the MCU and transmitted by the first current detection circuit is more than a set current value, the driving mechanism is judged to be in an operation state, otherwise, in an off-working state.

The position detection component of doors and windows comprises a second current detection circuit and a signal conversion circuit; the signal conversion circuit is connected to the MCU; the second current detection circuit obtains the continuous current of the driving mechanism; the continuous current is transmitted to the MCU after being converted through the signal conversion circuit; the MCU judges position information of the doors and the windows according to the collected current value; and the position judgment process of the doors and the windows is that: the MCU reads the positions of the doors and the windows from Falsh when energizing each time, and writes the positions of the doors and the windows into Falsh for saving on time;

The anti-theft component comprises a magnetic alarm sensor installed on the doors and the windows; and the magnetic alarm sensor connects the obtained signal to the MCU through an IO interface.

Further, a brushless direct current motor with medium and small power is selected by the driving mechanism, and comprises a servo motor, a driving motor, a hydraulic motor or a driving motor.

The present invention has the characteristics and beneficial effects: The intelligent control system for remote control of doors and windows of the present invention is designed in such a manner that the intelligent control end sends a control signal to a remote control terminal of doors and windows for realizing remote control of doors and windows. The intelligent control system has the characteristics of simple system design, ultra-low power consumption and large-scale use, can be used for remote control of diversified doors and windows like skylights, flat open doors and windows, doors and windows opened inside and outside, sliding doors and windows, etc., and can simultaneously realize intelligent remote control of multiple groups of doors and windows. In addition, humanized functions of preventing theft and automatically detecting states and positions of doors and windows are also added in the intelligent control system of the present invention, thereby providing intelligence, safety, convenience and economy for people's family life.

DETAILED DESCRIPTION OF EMBODIMENTS

The technical solution of the present invention will be described in detail in combination with FIGS. 1-6 below, but the protection scope of the present invention shall not be limited on this account.

Figure 1:
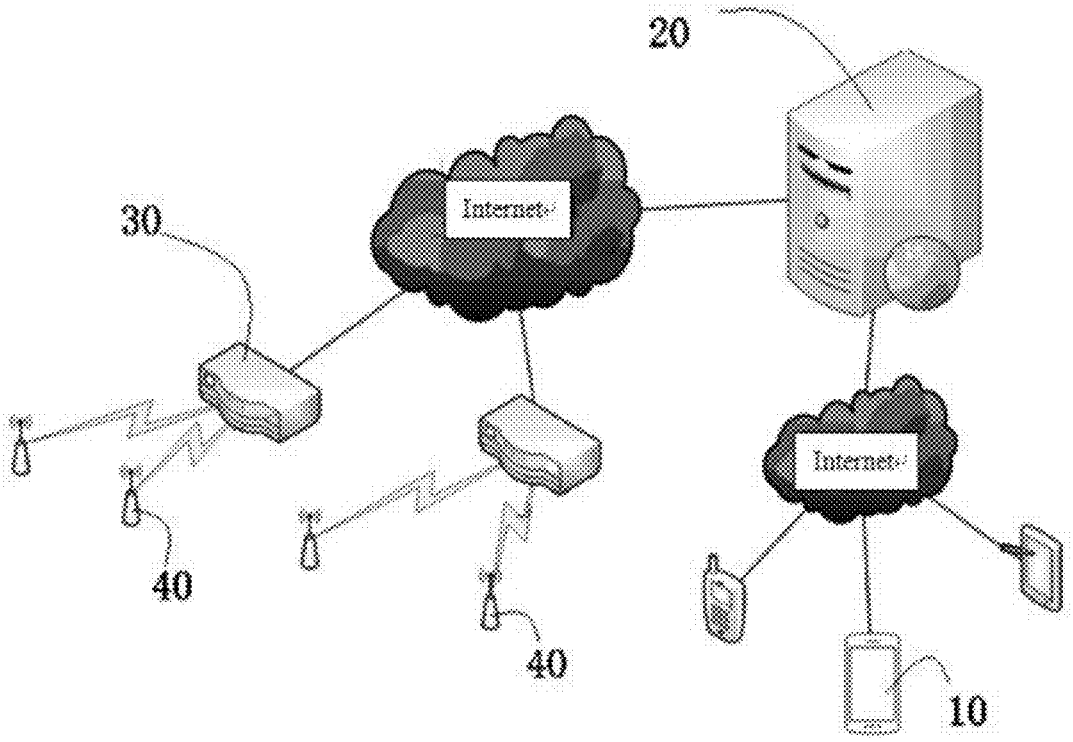
FIG. 1 is an overall structural diagram of an intelligent control system for remote control of doors and windows of the present invention.
Figure 2:
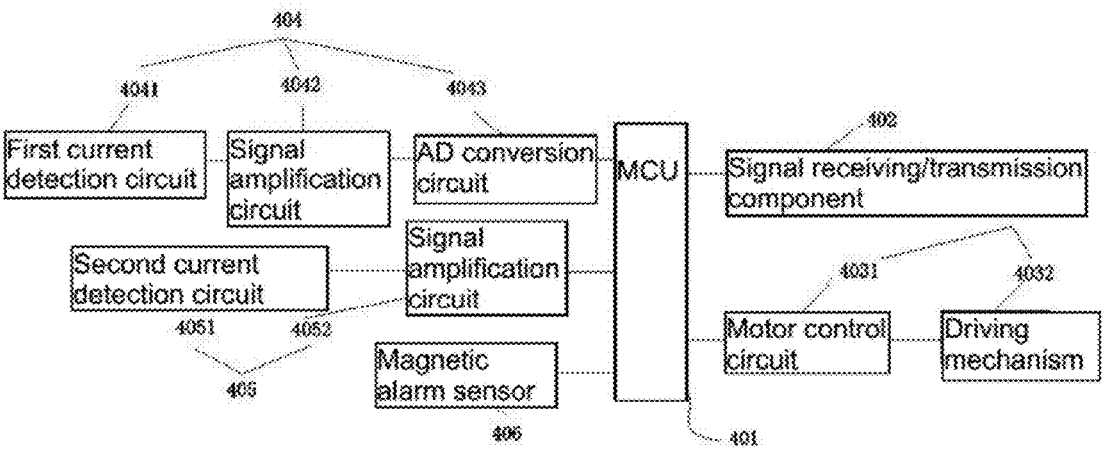
FIG. 2 is a structural diagram of a control terminal of doors and windows in FIG. 1.

FIG. 1 is an overall structural diagram of an intelligent control system of doors and windows of the present invention, and FIG. 2 is a structural diagram of a control terminal of doors and windows in FIG. 1; and the intelligent control system of doors and windows comprises an intelligent control end 10, a server 20, routers 30 and a control terminal 40 of doors and windows. The intelligent control end 10 is in communication connection with the server 20 through an Internet, the server 20 is in communication connection with the routers 30 through the Internet, and a local area, network of an Internet of Things is formed by the routers 30 and the control terminal 40 of doors and windows.

In the present invention, the intelligent control end 10 can adopt a smartphone, a tablet computer and the like. A control signal can be transmitted to the server 20 by inputting or selecting a corresponding control signal.

Moreover, the server 20 can be in network connection with a plurality of routers 30, thereby realizing the control of a plurality of systems of doors and windows. Each router 30 can form a small Internet of Things system.

The control terminal 40 of doors and windows comprises an MCU 401. The MCU 401 is connected with a signal receiving/transmission component 402, a mechanical component 403 for control of doors and windows, a detection component 404 of doors and windows, a position detection component 405 of doors and windows and an anti-theft component.

The signal receiving/transmission component 402 is used for receiving control information and sending information to the intelligent control end, and comprises a 2G or 3G or 4G signal module and/or a WIFI signal module, and/or a Bluetooth module, and/or a wireless receiving module, etc.; and the signal receiving/transmission component 402 is connected to the MCU 401 through an SPI or a UART interface.

The mechanical component 403 for control of doors and windows comprises a motor control circuit 4031, a driving mechanism 4032 and doors and windows connected with the driving mechanism 4032, wherein one end of the motor control circuit 4031 is connected with the MCU 401, and the other end is connected with the driving mechanism 4032 and used for controlling the action of the driving mechanism 4032 to realize the control of the doors and the windows. The motor control circuit 4031 controls the action of the driving mechanism 4032 according to the received signal, and the driving mechanism 4032 outputs the power and drives the opening and closing of the doors and the windows.

The detection component 404 of doors and windows comprises a first current detection circuit 4041, a signal amplification circuit 4042 and an AD conversion circuit 404 which are electrically connected successively, wherein the first current detection circuit 4041 is connected with the driving mechanism 4032 and obtains circuit information of the driving mechanism, and the AD conversion circuit 4043 is connected to the MCU 401; and if the current information received by the MCU 401 is more than a set value, the driving mechanism is judged to be in an operation state, otherwise, in an off-working state.

The position detection component 405 of doors and windows comprises a second current detection circuit 4051 and a signal conversion circuit 4052, wherein the second current detection circuit 4051 is connected with the driving mechanism 4032, and the current value is transmitted to the MCU 401 after being converted through the signal conversion circuit 4052; and the MCU 401 judges position information of the doors and the windows according to the collected current value. The position judgment process of the doors and the windows is that: the MCU reads the position of the doors and the windows from the flash memory when energizing each time, and writes the positions of the doors and the windows into the flash memory for the saving on time.

The anti-theft component comprises a magnetic alarm sensor 406 installed on the doors and the windows. The magnetic alarm sensor 406 transmits the obtained signal to the MCU 401 through an IO interface. In case of damage, an alarm signal is output by the magnetic alarm sensor 406, transmitted to the MCU 401, and finally transported to the intelligent control end 10.

A brush less direct current motor with medium and small power is selected by the driving mechanism, and comprises a servo motor, a driving motor, a hydraulic motor or a driving motor.

Embodiment 1

Figure 3:
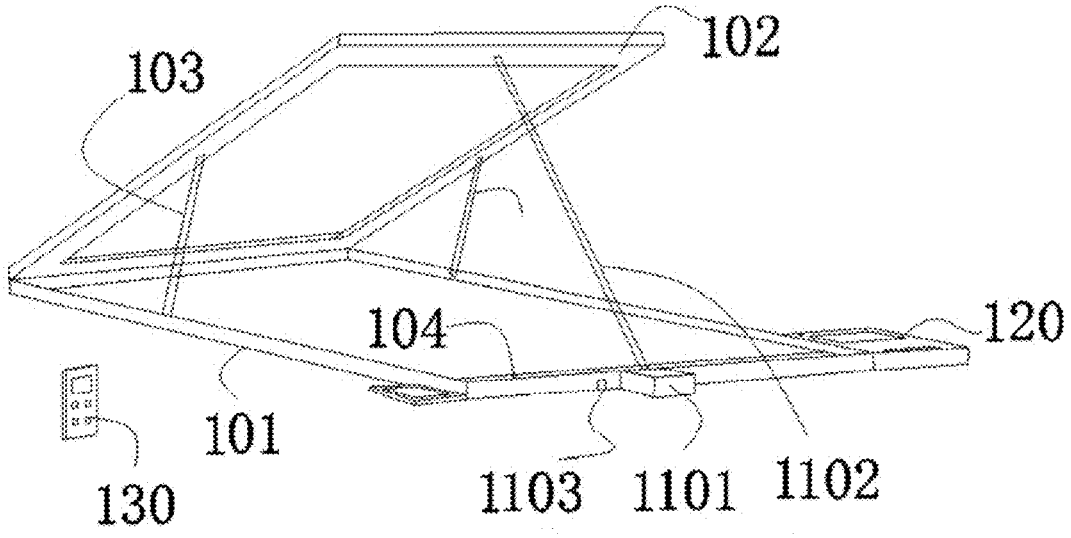
FIG. 3 is a structural diagram of a skylight of an intelligent control system according to Embodiment 1 of the present invention.

An intelligent control system for remote control of a skylight is shown in FIG. 3. The skylight comprises a window shelf 101, wherein the window shelf 101 is coordinated with a window frame 102, and the upper frame of the window frame 102 is rotatably connected with the window shelf 101 by hinges. A driving mechanism is arranged at the lower frame of the window shelf 101 and the driving mechanism is a first hydraulic motor 1101; a first hydraulic push rod 1102 is connected to the first hydraulic motor 1101, and the other end of the first hydraulic push rod 1102 is connected to the lower frame of the window frame 102; and a motor control circuit is a first receiver chip 1103, and the first hydraulic motor 1101 is connected with the first receiver chip 1103.

More favorably, a telescopic second hydraulic push rod 103 is rotationally connected on two side frames of the window frame 102 respectively, and the other end of the second hydraulic push rod 103 is rotationally connected on corresponding left and right shelves of the window shelf 101, thereby ensuring the stability and safety of the window frame 102 in an opening and closing process.

Specifically, a control terminal 120 of doors and the windows comprises an MCU. The MCU is connected with a signal receiving/transmission component, a first receiver chip 1103, a detection component of doors and windows, a position detection component of doors and windows, automatic alarm devices and a WIFI module, wherein two automatic alarm devices 104 are arranged at the lower shelf of the window shelf 101 and connected with an alarm through a wire; so, when the window frame 102 or the window shelf 101 is damaged, such as be warped, the automatic alarm devices 104 are triggered, a signal is transmitted to the alarm through the automatic alarm devices, and the alarm sounds an alarm externally.

In the Embodiment, control information can be sent to the MCU through a remote control device 130, a wireless receiving module 433 in the signal receiving/transmission component sends the received signal to the MCU, the MCU transmits the control information to the first receiver chip 1103, the first receiver chip 1103 controls the output of the first hydraulic motor 1101 automatically, and finally, the automatic control for the window frame 102 is realized; and meanwhile, remote control signals from outside can be received through a signal receiving/transmitting end and finally transmitted to the first receiver chip 1103, and the automatic control for the window frame 102 is realized by the driving mechanism. The remote control signals from outside can also be received through 2G/3G/4G modules or the WiFi module and finally transmitted to the driving mechanism, and the automatic control for the window frame 102 is realized by the driving mechanism.

Embodiment 2

Figure 4:
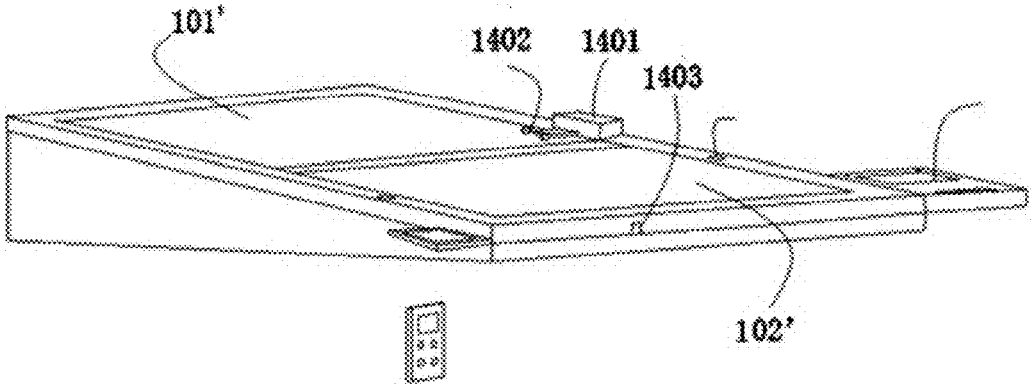
FIG. 4 shows structural diagrams of a skylight of an intelligent control system according to Embodiment 2 of the present invention.
Figure 4:
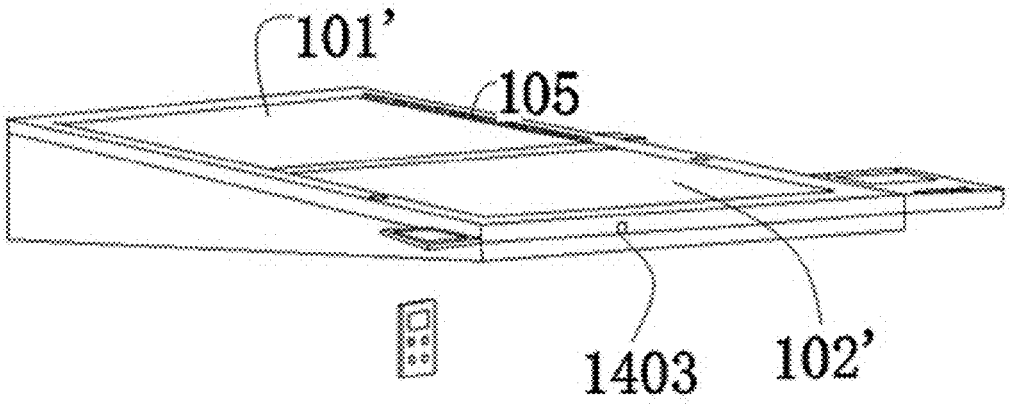

An intelligent control system for remote control of a skylight is shown in FIG. 4. The difference between the Embodiment and Embodiment 1 is that, the window frame comprises a movable fan 101' and a fixed fan 102'. The driving mechanism is a second hydraulic motor 1401, the second hydraulic motor 1401 is connected with a drive roller 1402 and transmits power to the drive roller 1402, a motor control circuit is a second receiver chip 1403, and the second hydraulic motor 1402 is connected with the second receiver chip 1403; and the drive roller 1402 is engaged with a rack 105 arranged on the inner side surface of the side fan of the movable fan 101', so that the movable fan 101' can slide along the inner side surface of the side frame of the window shelf.

Specifically, the second hydraulic motor 1401 transmits the power to the drive roller 1402 when receiving control information, and the drive roller 1402 is engaged with the rack 105, therefore, the drive roller 1402 drives the rack 105 to slide in a rotation process of the drive roller 1402, namely, the opening and closing of the skylight are realized by doing a reciprocating motion along the window shelf. In addition, in order to realize the security, an induction alarm device is arranged at the lower part of the window shelf, and the working principle of the induction alarm device is the same as the alarm principle of Embodiment 1, and therefore, will not be repeated here.

Embodiment 3

Figure 5:
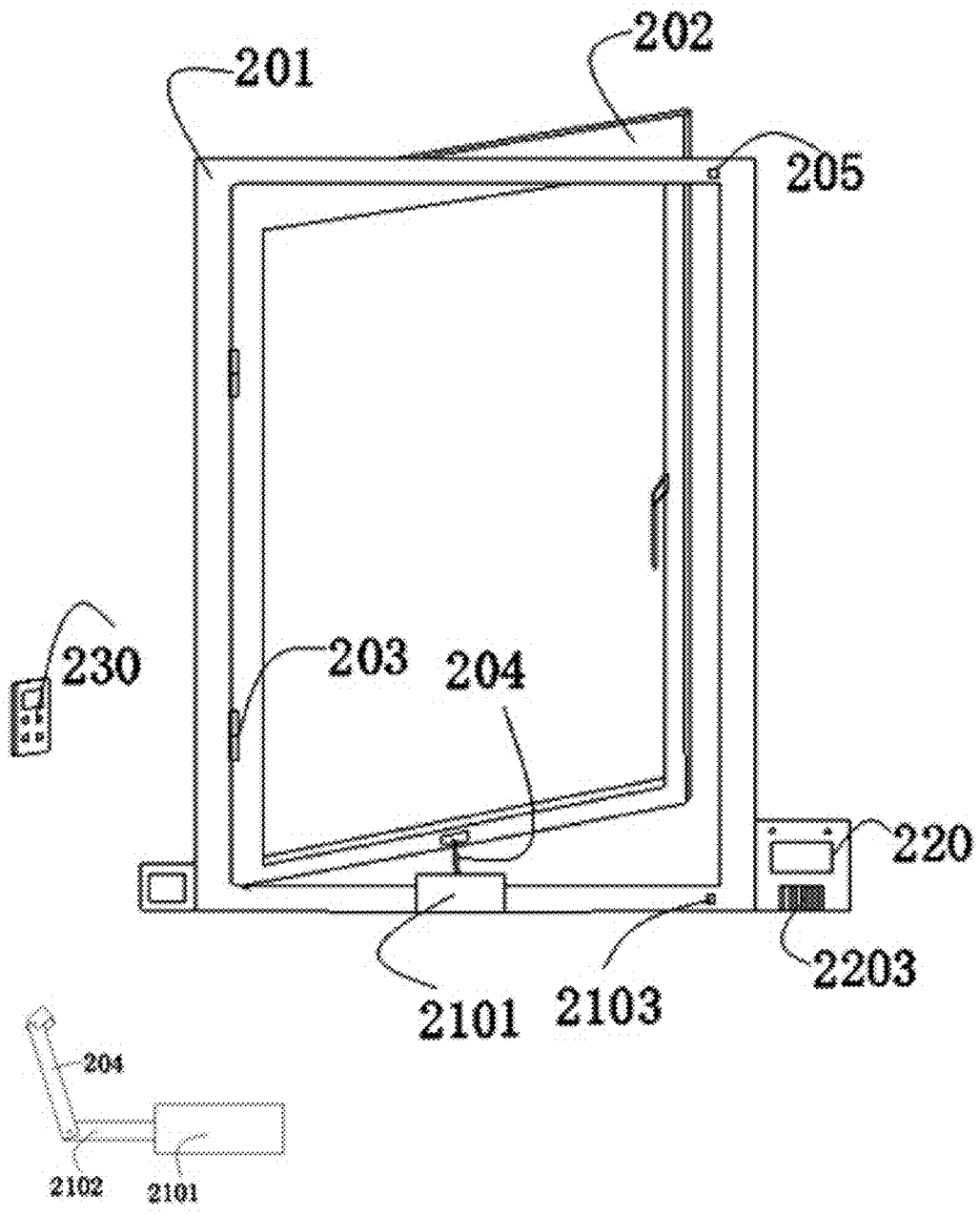
FIG. 5 shows structural diagrams of flat open doors and windows of an intelligent control system according to Embodiment 3 of the present invention.

An intelligent control system for remote control of flat open doors and windows is shown in FIG. 5. The flat open doors and windows comprise a window shelf (a door shelf) 201, wherein the window shelf 201 is connected with a flat open window frame (door frame) 202 by a hinge 203. A driving mechanism is arranged at the lower bottom edge of the window frame 202 and the driving mechanism is a hydraulic driving motor 2101; the output end of the hydraulic driving motor 2101 is connected with a hydraulic rod 2102, a motor control circuit is a first receiver chip 2103, and the hydraulic driving motor 2101 is connected with the first receiver chip 2103; and the hydraulic rod 2102 is rotationally connected with a connecting rod 204, and the other end of the connecting rod 204 is rotationally connected with the window frame 202. The mechanical energy is converted by the hydraulic driving motor 2101 by a hydraulic pressure, thereby pushing the hydraulic rod 2102 to do a linear motion; and the hydraulic rod 2102 pushes the connecting rod 204 to move, and finally, the rotation of the window frame 202 is realized.

Specifically, a control terminal 220 of doors and windows comprises an MCU. The MCU is connected with a signal receiving/transmission component, a first receiver chip 2103, a detection component of doors and windows, a position detection component of doors and windows, automatic alarm devices and a WiFi module, wherein two automatic alarm devices 205 are arranged on the window shelf 201 and arranged at the right of the window shelf 201, namely, near the right end of the window frame 202 and an opening and closing place of the window shelf 201; so, when the window frame 202 or the window shelf 201 is damaged, such as be warped and the like, the automatic alarm devices 205 are triggered, a signal is transmitted to an alarm 2203 through the automatic alarm devices 205, and the alarm 2203 sounds an alarm externally.

In the Embodiment, control information can be sent to the MCU through a remote control device a wireless receiving module 433 in the signal receiving/transmission component sends the received signal to the MCU, the MCU transmits the control information to the receiver chip 2103, the receiver chip 2103 controls the output of the hydraulic driving motor 2101 automatically, and finally, the automatic control for the window frame 202 is realized. Remote control signals from outside can also be received through 2G/3G/4G modules or the WiFi module and finally transmitted to the driving mechanism, and the automatic control for the window frame 202 is realized by the driving mechanism.

Embodiment 4

Figure 6:
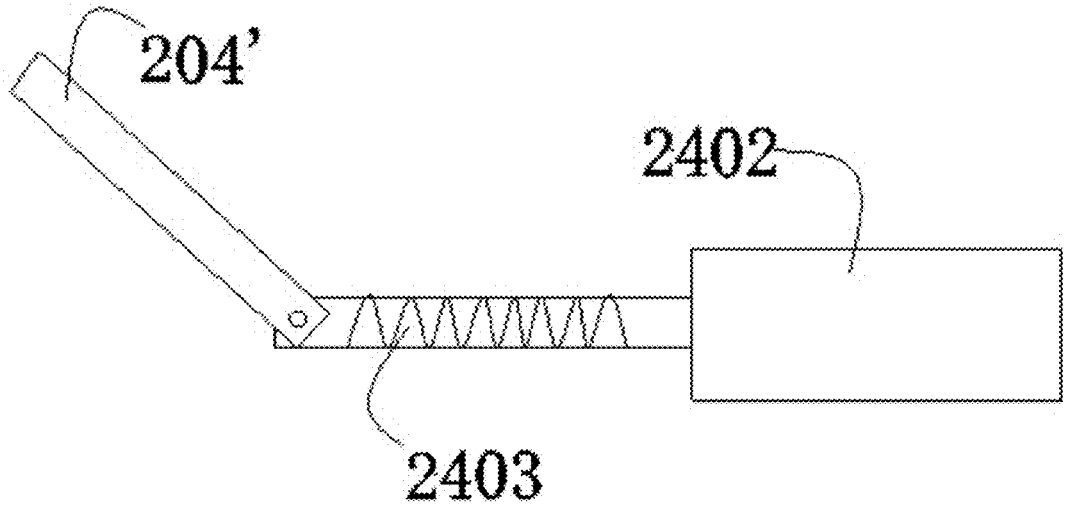
FIG. 6 is a structural diagram of flat open doors and windows of an intelligent control system adopted in Embodiment 4 of the present invention.

An intelligent control system for remote control of flat open doors and windows is shown in FIG. 6. The difference between the Embodiment and Embodiment 3 is that, the driving device is a driving motor 2402, a motor control circuit is a second receiver chip, and the driving motor 2402 is connected with the second receiver chip and controls the movement of a connecting rod 204' through a rotating device 2403. Specifically, the rotating device 2403 can be a worm or a gear box.

Embodiment 5

Figure 7:
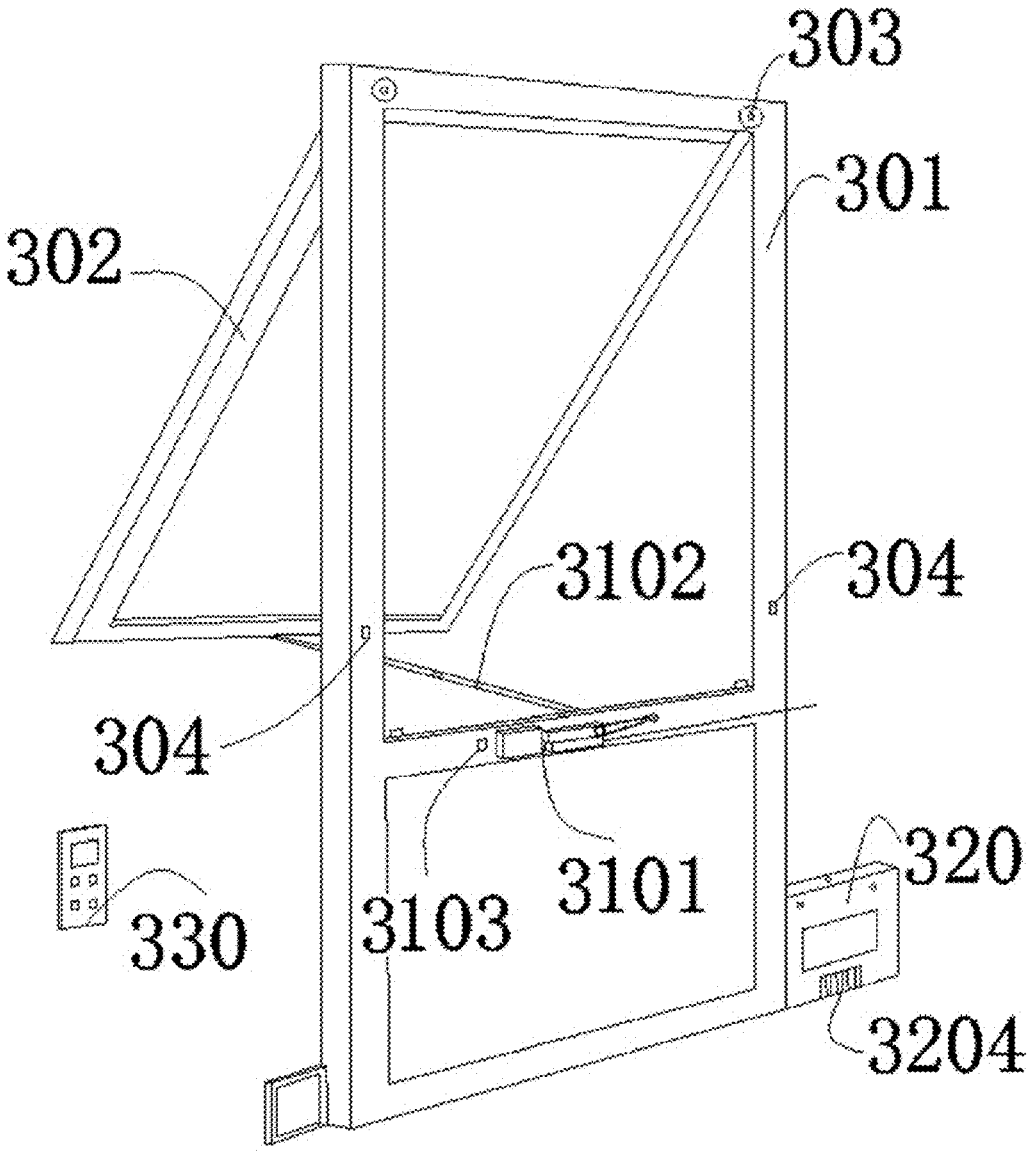
FIG. 7 is a structural diagram of topspin doors and windows opened inside and outside of an intelligent control system according to Embodiments 5 and 6 of the present invention.

An intelligent control system for remote control of topspin doors and windows opened inside and outside is shown in FIG. 7. The topspin doors and windows opened inside and outside comprise a window shelf (a door shelf) 301, wherein the upper part of the window shelf 301 is connected with a window frame (a door frame) 302 through a metal hinge 303, and the window frame 302 can do a rotational motion around an upper shelf of the window shelf 301. A driving mechanism is arranged at a middle and horizontal mullion of the window shelf 301 and is a hydraulic motor 3101, the hydraulic motor 3101 is horizontally arranged along the middle and horizontal mullion, the output end of the hydraulic motor is connected with a hydraulic connecting rod 3102, the other end of the hydraulic connecting rod 3102 is connected with the lower frame of the window frame 302, a motor control circuit is a second receiver chip 3103, the hydraulic motor 3101 is connected with the second receiver chip 3103, and when the second receiver chip 3103 receives a control signal, the hydraulic motor 3101 produces power and drives the hydraulic connecting rod 3102 to move, thereby controlling the opening and closing of he window frame 302.

Specifically, a control terminal 320 of doors and the windows comprises an MCU. The MCU is connected with a signal receiving/transmission component, a first receiver chip 3103, a detection component of doors and windows, a position detection component of doors and windows, automatic alarm devices and a WiFi module, wherein two automatic induction devices 304 are arranged at the frame of the window shelf 301 and arranged at one side closing to the driving mechanism; so, when the window frame 302 or the window shelf 301 is damaged, such as be warped and the like, the automatic induction devices 304 are triggered, a signal is transmitted to an alarm 3204 through the automatic induction devices 304, and the alarm 3204 sounds an alarm externally.

In the Embodiment, control information can be sent to the MCU through a remote control device 330, a wireless receiving module 433 in the signal receiving/transmission component sends the received signal to the MCU, the MCU transmits the control information to a second receiver chip 3103, the second receiver chip 3103 controls the output of the hydraulic driving motor 3101 automatically, and finally, the automatic control for the window frame 302 is realized. Remote control signals from outside can also be received through 2G/3G/4G modules or the WiFi module and finally transmitted to the driving mechanism, and the automatic control for the window frame 302 is realized by the driving mechanism.

Embodiment 6

Figure 8:
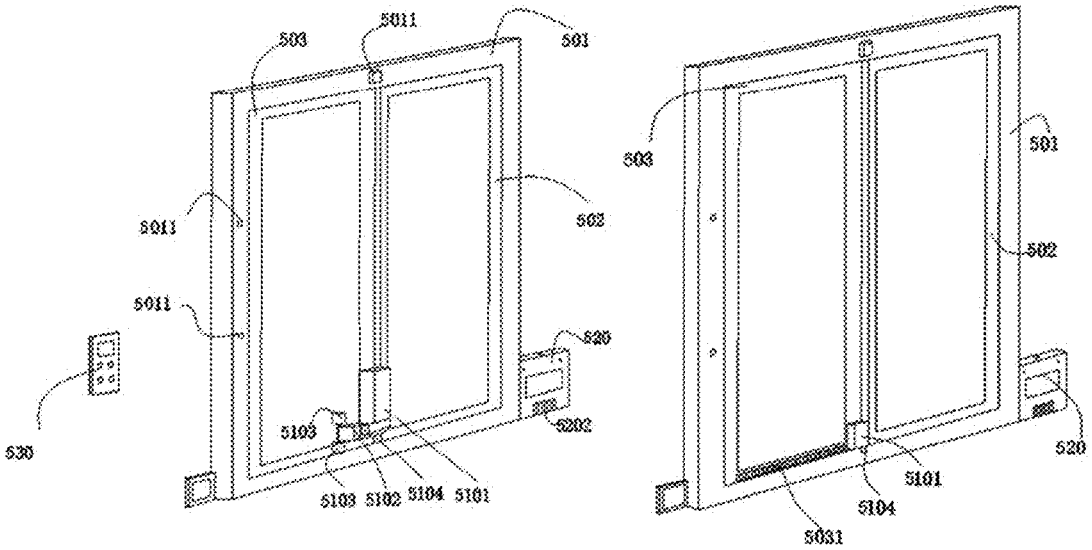
FIG. 8 is a structural diagram of sliding doors and windows of an intelligent control system according to Embodiment 7 of the present invention.

An intelligent control system for remote control of topspin doors and windows opened inside and outside is shown in FIG. 8. The difference between the Embodiment and Embodiment 5 is that, a driving mechanism is a driving motor, the driving motor is connected with a first receiver chip used for controlling the rotation of the driving motor, and the output end of the driving motor is connected with a mechanical connecting rod. The specific working process of the driving motor is similar to a control process of driving mechanism in Embodiment 5.

Embodiment 7

An intelligent control system for remote control of sliding doors and windows is shown in FIG. 8. The sliding doors and windows comprise a window shelf (a door shelf) 501, wherein a first window frame (door frame) 502 and a second window frame (door frame) 503 are arranged on the window shelf 501; and the first window frame 502 is located in the front side of the second window frame 503. A driving mechanism is arranged at a place close to a lower end at the left side of the first window frame 503 and is a driving motor 5101, and the driving motor 5101 is arranged vertically, and the output end of the driving motor is downward; the driving motor 5101 is an electrodeless control walking motor; and specifically, the driving motor 5101 is detachably fixed on the first window frame 502 through a thread, or clamped and fixed on the first window frame 502 through a clamping device. The output end of the driving motor 5101 is connected with a transmission device 5102, and the transmission device 5102 is engaged and rotated with rollers 5103 on the transmission device 5102 of the driving motor. A rack 5031 is arranged at the bottom edge of the second window frame 503 horizontally and meshed with the rollers 5103, and the rollers 5103 drive the rack 5031 to slide from left to right when rotating, thereby realizing the automatic control for the second window frame 502. Specifically, two upper and lower rollers 5103 are arranged, so the driving motor 5101 can be arranged above the first window frame 502, and the automatic control is realized as well. The transmission device 5102 in the Embodiment is a gear box, and the slowdown treatment of an output speed of the driving motor 5101 can be realized through the gear box, thereby ensuring to slowly carry out the slowdown treatment when controlling the second window frame 503.

Further, a motor control circuit is a receiver chip 5104, the receiver chip 5104 is connected with the driving motor 5101, and the automatic control for the driving motor 5101 is realized through the receiver chip 5104. A control terminal 520 of doors and windows is arranged at the right side of the window shelf 501 and comprises an MCU. The MCU is connected with a signal receiving/transmission component, a receiver chip 5103, a detection component of doors and windows, a position detection component of doors and windows, automatic alarm devices and a WiFi module, wherein the automatic induction alarm devices 5011 are arranged around the window shelf 501 and connected with an alarm 5202 through a wire. When the doors and windows are damaged, the automatic induction alarm devices 5011 are triggered, a signal is transmitted to an alarm 5202 through the automatic induction alarm devices 5011, and the, alarm 5202 sounds an alarm warning, Specifically, the technical solution of the Embodiment is that a remote control device 530 is provided. A control signal is sent to a control device 520 through the remote control device 530, a wireless receiving module 433 in the signal receiving/transmission component sends the received signal to the MCU, and the control signal is transmitted to the receiver chip 5104 after being processed by a processor, so the receiver chip 5104 can realize the automatic control for the second window frame 503. In addition, the remote intelligent control can also be carried out in the Embodiment, in addition to carry out the close control with a remote controller 530, and a remote signal is received through a remote signal receiver, transmitted to the processor and finally transmitted to the receiver chip 5104, thereby realizing the control for the second window frame 503.

According to the revelation and instruction of the above-mentioned description, those skilled in the art of the present invention can also change and modify the above embodiments. Therefore, the present invention is not limited to the detailed description of embodiments revealed and described above, and some modifications and changes of the present invention shall also fall into the protection scope of claims of the present invention. In addition, although some specific terms are used in the description, these terms are stated for the convenience of explanation and have no any limit to the present invention.

I claim:

1. An intelligent control system for remote control of doors and windows, comprising:

an intelligent control end, a server and a control terminal of doors and windows; the intelligent control end sends a remote control command to the control terminal of doors and windows through the server; the control terminal of doors and windows processes a received remote control command and executes a corresponding control action to finish remote control of doors and windows;

wherein the control terminal of doors and windows comprises an MCU; the MCU is connected with a signal receiving/transmission component, a mechanical component for control of doors and windows, a detection component of doors and windows, a position detection component of doors and windows and an anti-theft component;

the signal receiving/transmission component is used for receiving control information and sending information to the intelligent control end;

the mechanical component for control of doors and windows comprises a motor control circuit, a driving mechanism and doors and windows connected with the driving mechanism; the motor control circuit is connected with the driving mechanism for controlling an action of the driving mechanism to realize the control of the doors and the windows;

the signal receiving/transmission component is connected to the MCU through an SPI or a UART interface;

the detection component of doors and windows comprises a first current detection circuit, a signal amplification circuit and an AD conversion circuit which are electrically connected successively; the AD conversion circuit is connected to the MCU; and if the current information received by the MCU and transmitted by the first current detection circuit is more than a set current value, the driving mechanism is judged to be in an operation state, otherwise, in an off-working state;

the position detection component of doors and windows comprises a second current detection circuit and a signal conversion circuit; the signal conversion circuit is connected to the MCU; the second current detection circuit obtains the continuous current of the driving mechanism; the continuous current is transmitted to the MCU after being converted through the signal conversion circuit; the MCU judges position information of the doors and the windows according to a collected current value; the MCU is configured to read the positions of the doors and the windows from a flash memory when energizing each time, and write the positions of the doors and the windows into the flash memory for saving on time;

the anti-theft component comprises a magnetic alarm sensor installed on the doors and the windows; and the magnetic alarm sensor connects the obtained signal to the MCU through an IO interface of the MCU.

* * * * *